United States Patent [19]

Haupt

[11] Patent Number: 4,578,680

[45] Date of Patent: Mar. 25, 1986

[54] FEED DISPLACEMENT CORRECTION IN A SPACE FED LENS ANTENNA

[75] Inventor: Randy L. Haupt, Stow, Mass.

[73] Assignee: The United States of America as represented by the Secretary of the Air Force, Washington, D.C.

[21] Appl. No.: 606,325

[22] Filed: May 2, 1984

[51] Int. Cl.[4] ..... H01Q 3/36

[52] U.S. Cl. ..... 343/703; 343/372; 343/754

[58] Field of Search ..... 343/703, 753, 754, 755, 343/371, 372

[56] References Cited

U.S. PATENT DOCUMENTS

| | | | |
|---|---|---|---|
| 3,378,846 | 4/1968 | Lowenschuss | 343/703 |
| 3,971,022 | 7/1976 | Lenz | 343/754 |
| 4,010,471 | 3/1977 | Smith | 343/754 |
| 4,246,585 | 1/1981 | Mailloux | 343/854 |
| 4,270,129 | 5/1981 | Herper | 343/703 |

OTHER PUBLICATIONS

Neiswander, R. S. (1978), Inflight Optical Measurement of Antenna Surfaces, *1978 Large Space System Technology Proceedings*, vol. 1, NASA Conference Publication 2035, pp. 457–490.

Davis L. et al. (1978), Structural Alignment Sensor, *1978 Large Space System Technology Proceedings*, vol. 1, NASA Conference Publication 2035, pp. 491–506.

Neiswander, R. S. (1981), Conceptual Design of a Surface Measurement System for Large Deployable Space Antennas, *1981 Large Space Systems Technology Proceedings*, Part 2, NASA cp-2215, pp. 631–640.

Collyor, P. W. et al. (1981), Electro-Optical System for Remote Position Measurements in Real Time, *1981 Large Space Systems Technology Proceedings*, Part 2, NASA cp 2215, pp. 641–656.

*Primary Examiner*—Eli Lieberman

*Attorney, Agent, or Firm*—Donald J. Singer; Richard J. Donahue

[57] ABSTRACT

A space fed microwave lens antenna for deployment in outer space or other remote, hazardous or unattended location. Electronic means are provided for compensating for errors in the mechanical displacement of the phased array feed elements from the phased array lens elements.

7 Claims, 26 Drawing Figures

FIG. 3A
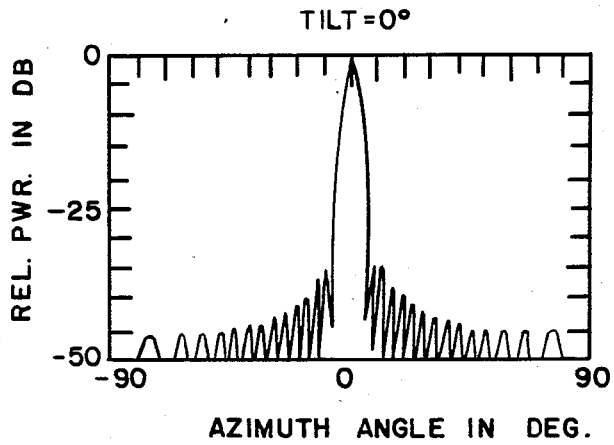
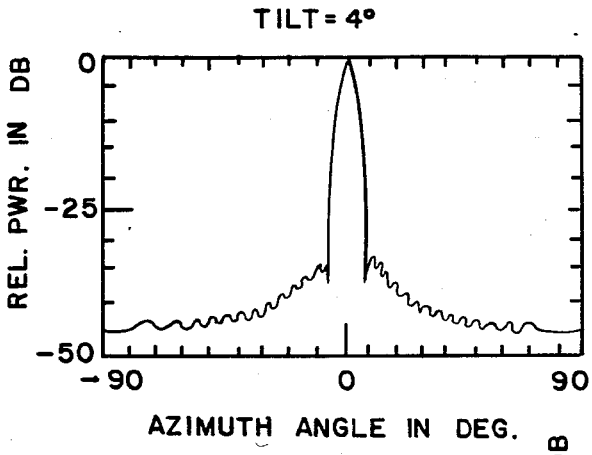
FIG. 3B
FIG. 3C
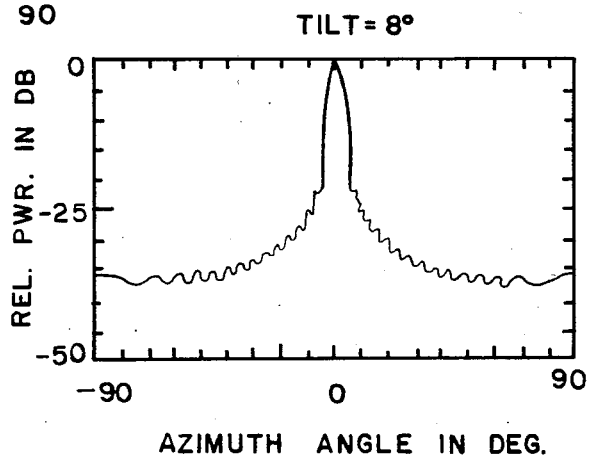
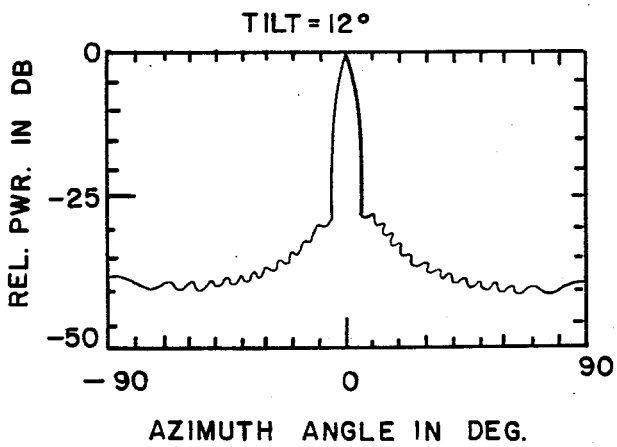
FIG. 3D

FIG. 4A
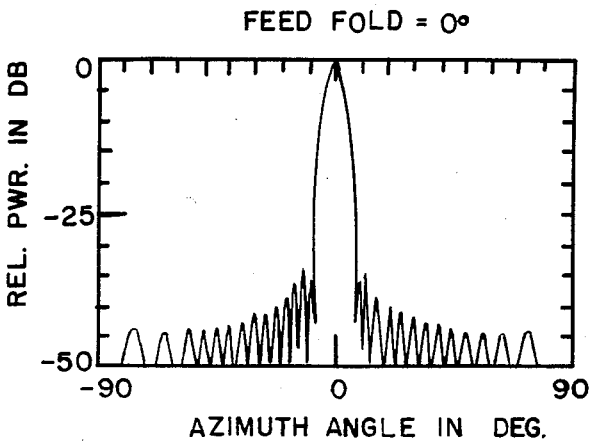
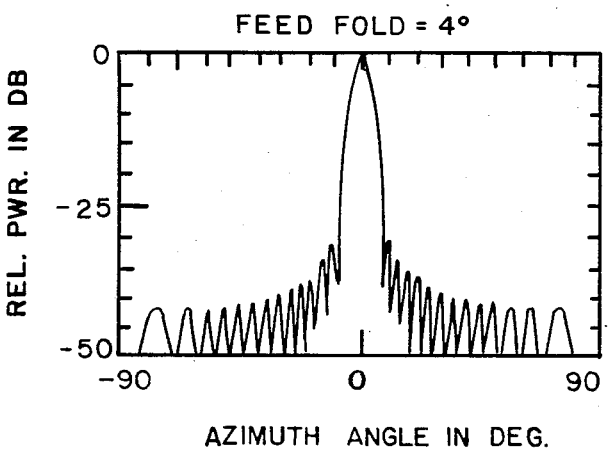
FIG. 4B
FIG. 4C
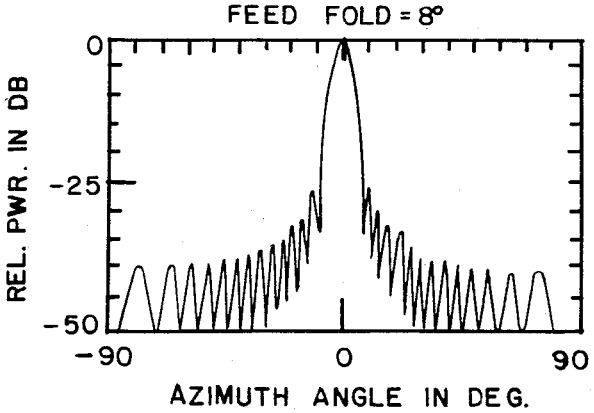
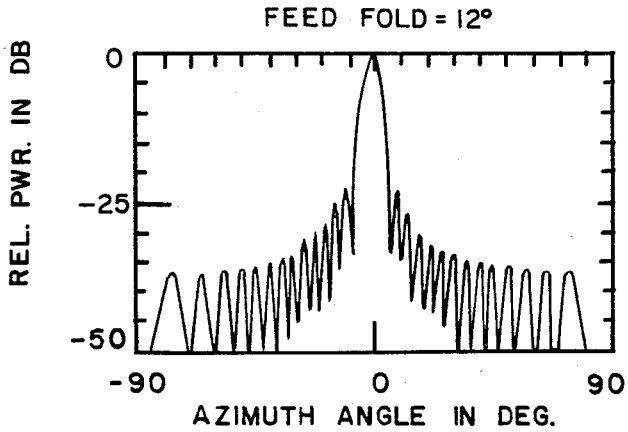
FIG. 4D

FIG.5A
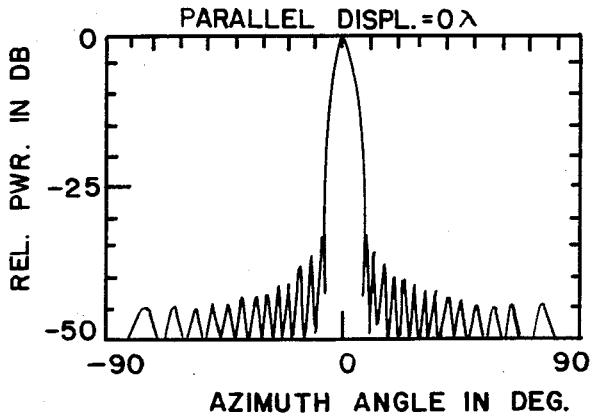
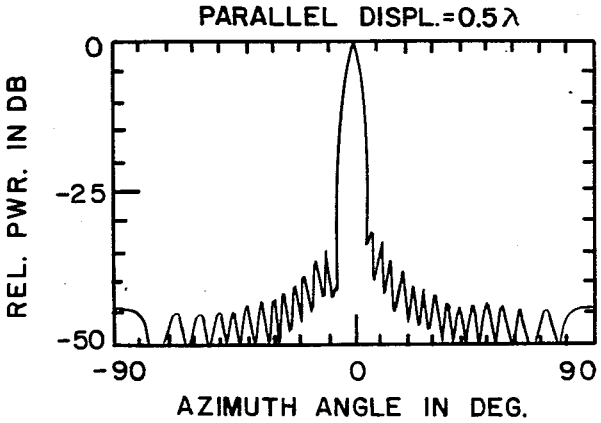
FIG.5B
FIG.5C
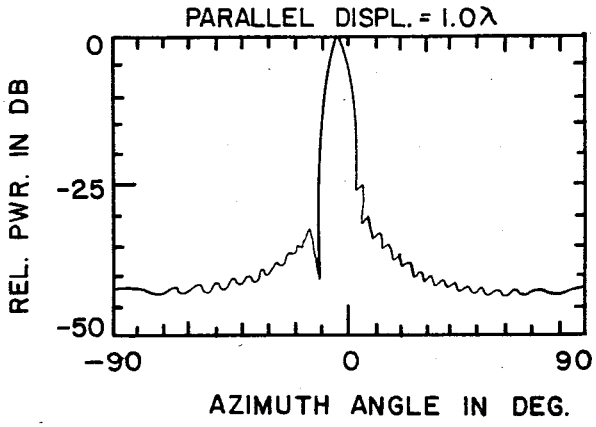
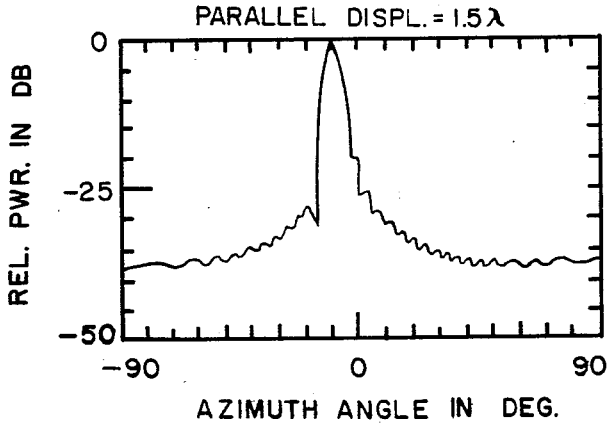
FIG.5D

FIG. 6A
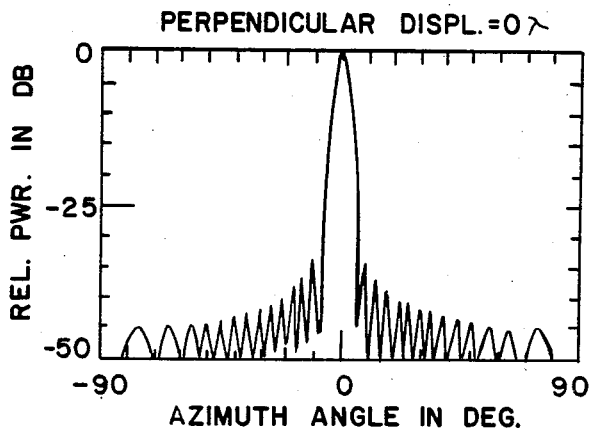
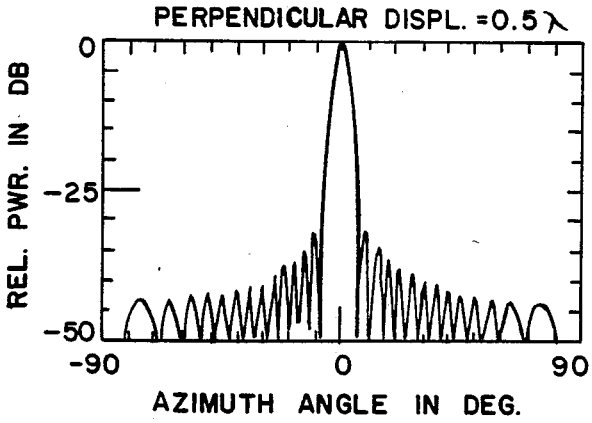
FIG. 6B
FIG. 6C
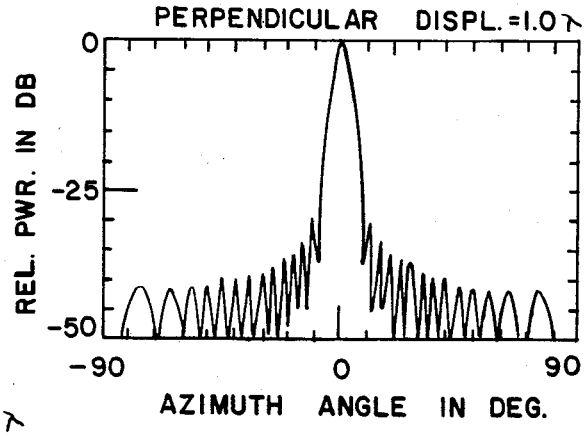
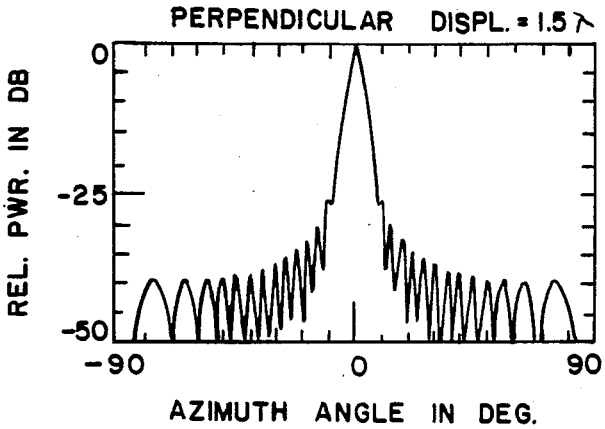
FIG. 6D

FIG. 7A
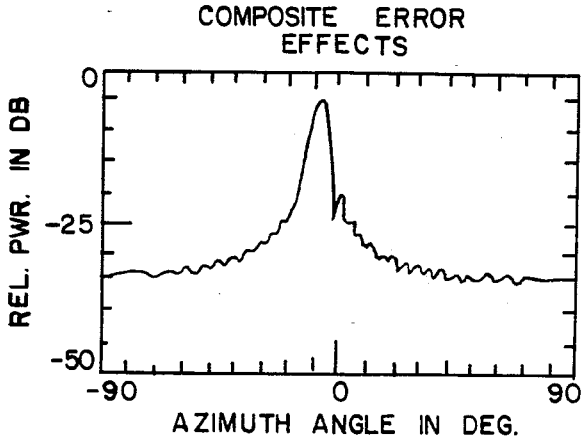
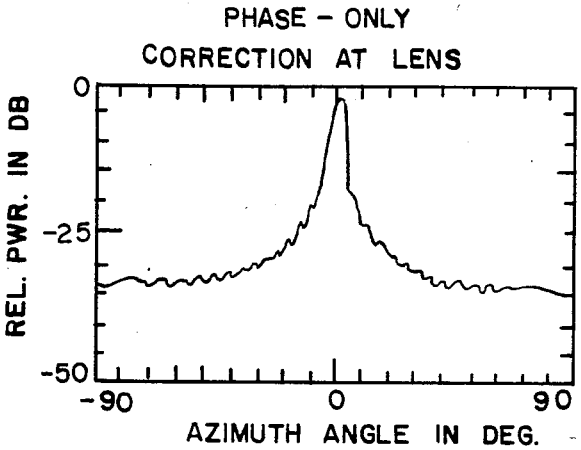
FIG. 7B
FIG. 7C
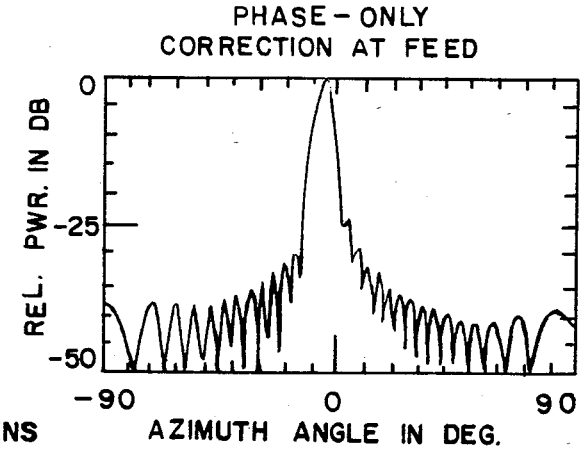
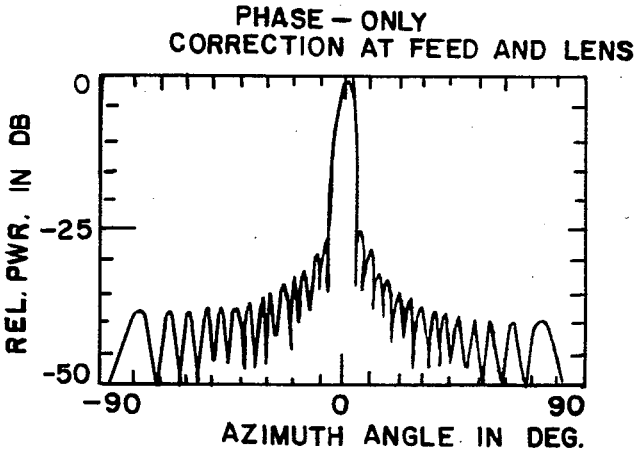
FIG. 7D

FEED DISPLACEMENT CORRECTION IN A SPACE FED LENS ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention concerns apparatus and a method for electronically compensating for the physical misalignment of a space fed microwave lens antenna. More particularly, it concerns apparatus and a method for accomplishing such correction in a space fed lens antenna deployed in outer space or other such remote or unattended location.

The cost of deploying very large phased array antennas has thus far favored reflector type antennas, regardless of application. When fielded, array antennas have tended to be unique installations that have cost up to ten thousand dollars per radiating element. New developments in solid state technology promise to change this condition as the production cost of a single chip transceiver and element approach the hundred-dollar level. This should result in a proliferation of large, agile beam solid state antennas in a number of interesting applications that require high gain, wide bandwidth, and electronic countermeasure (ECM) resistance.

The hundred-dollar transceiver is expected to contain a phase shifter, power amplifier, low noise amplifier, T/R switches, and a microprocessor. This technology advancement has the potential to support a very large, affordable, active aperture antenna with limited intelligence at the element level. However, the problem of distributing the rf energy to the antenna face is made more difficult as the array size increases. Feeding this antenna will be a major technical challenge.

When volume is not a prime concern, an attractive solution to the feeding problem is the space fed microwave lens. The size, weight and mechanical complexity of a constrained feed is avoided, and the "double transform" nature of the feed-lens combination affords the antenna designer a second level of control over the radiative properties of the system.

As long as scattering from support structures can be controlled, a small feed array can position an amplitude distribution on the rear face of the lens appropriate for producing a low sidelobe antenna pattern. By using a multibeam transform feed, the lens may be illuminated with overlapped subarrays that permit operation over a wide instantaneous bandwidth. Thus, the microwave lens has the potential to meet most of the advanced sensor requirements of future systems in radar and communications.

As the preceeding background suggests, the mechanical and electrical aspects of the feed array will affect the success of a space fed microwave lens. Control of deterministic and random feed errors will determine its ultimate rf performance. Predicting and understanding the effects of these errors is the first step toward controlling and, if necessary, actively compensating for them. For this reason a study was conducted to determine the effects of various feed errors upon the electromagnetic performance of a microwave lens antenna system.

SUMMARY OF THE INVENTION

It is therefore an object of the present invention to provide electronic compensation for physical misalignment of a space fed microwave lens antenna.

It is a further object of the present invention to provide a closed loop antenna feed position monitoring and error compensation system for a space fed microwave lens antenna.

It is an additional object of the present invention to provide a self aligning space fed lens antenna particularly suited for deployment in an unattended, inaccessible or hostile environment.

In accordance with the present invention, a space fed lens antenna has associated therewith a range finder for determining the actual physical displacement of its phased array feed from it phased array lens. Such location information is coupled to a computer/controller which calculates correction factors to be applied to the feed and lens phase shifters and, in some applications, to feed amplitude control units. As a result, any deficiencies in the far field antenna pattern caused by physical misalignment of the antenna components are electronically compensated for and the antenna pattern is restored to the optimum condition.

These and other advantages, objects and features of the invention will become more apparent after considering the following description taken in conjunction with the illustrative embodiment in the accompanying drawings.

BRIEF DESCRIPTION OF THE DRAWINGS

FIG. 2*a* illustrates the proper feed displacement while

FIGS. 3*a*–3*d* are graphs depicting the effect of feed tilt of various degrees on a space fed microwave lens antenna;

FIGS. 4*a*–4*d* are graphs depicting the effect of feed fold of various degrees on a space fed microwave lens antenna;

FIGS. 5*a*–5*d* are graphs depicting the effects of parallel displacement on a space fed microwave lens antenna;

FIGS. 6*a*–6*d* are graphs depicting the effects of perpendicular displacement on a space fed microwave lens system;

FIG. 7*a* is a graph depicting the composite error effects upon a space fed microwave lens antenna system; and FIGS. 7*b*, 7*c* and 7*d* are graphs depicting the effects of phase corrections made by the present invention at the lens, feed and both lens and feed, respectively.

DETAILED DESCRIPTION OF THE INVENTION

Figure 1:
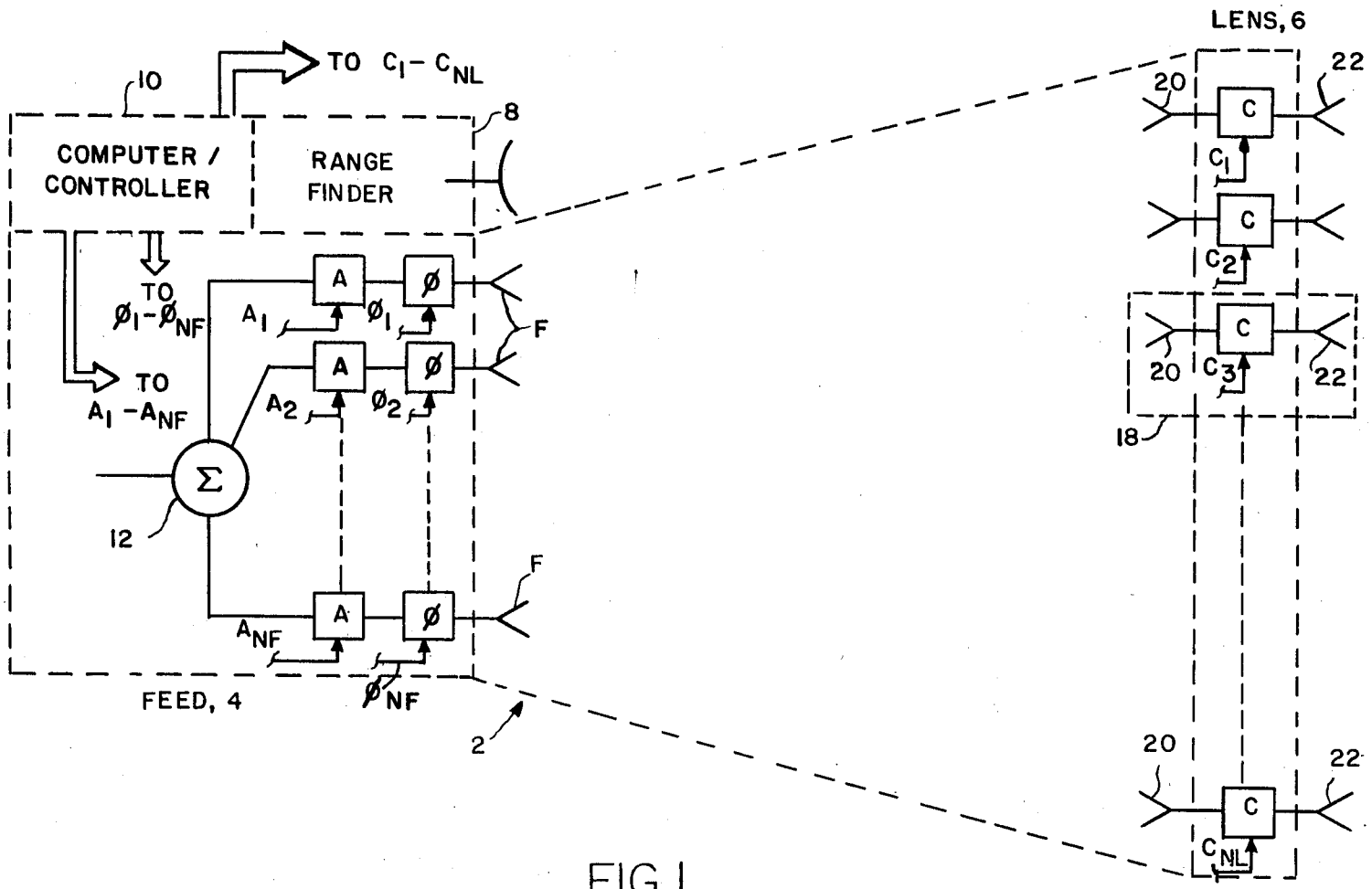
FIG. 1 is a diagrammatic representation of the space fed microwave lens antenna of the present invention.
Figure 2A:
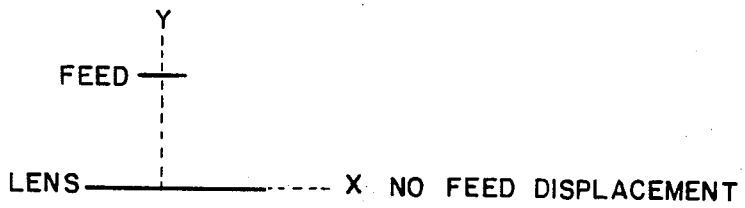
Figure 2B:
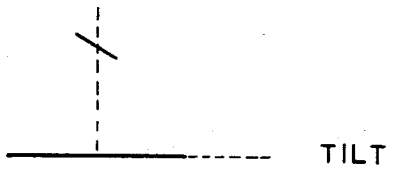
FIGS. 2*b*–2*e* illustrate various types of feed distortion geometries encountered in space fed lens antenna systems.
Figure 2C:
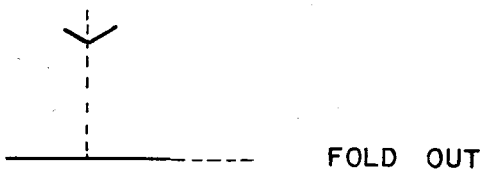
Figure 2D:
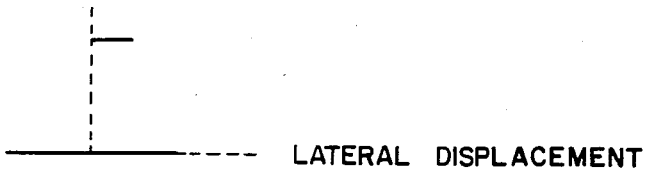
Figure 2E:
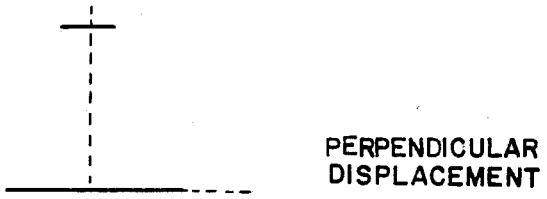

FIG. 1 is a diagrammatic representation of a space fed lens antenna 2 having a phased array feed 4, a phased array lens 6, a range finder 8 and a computer/controller 10. A signal summing unit 12 couples electromagnetic energy from a transmitter (not shown) to each of the variable signal amplitude control units A within the phased array feed 4. Output signals from individual ones of the amplitude control units A are in turn coupled to their associated phase shifters $\phi$ and thence to their associated feed elements F.

During signal reception, the signal flow is reversed to the signal summing unit 12, and the return signals are thereafter coupled to a receiver of conventional design. Amplitude control units A and phase shifters $\phi$ receive control signals from computer/controller 10 as discussed in detail below.

Range finder 8 is required in the present invention to determine the actual physical distances from each feed element F to various points on the surface of the phased array lens 6. Range finder 8 may be a laser type range finding device and triangulation might be used to accurately locate parts of the lens array 6 relative to the feed array 4.

Such range finding triangulation techniques and associated equipment for space deployed antennas are discussed in the following publications:

Neiswander, R. S. (1978) Inflight optical measurement of antenna surfaces, 1978 *Large Space System Technology Proceedings, Vol.* 1, NASA Conference Publication 2035, pp 457–490.

Davis L. et al (1978) Structural alignment sensor, 1978 *Large Space System Technology Proceedings, Vol.* 1, NASA Conference Publication 2035, pp. 491–506.

Neiswander, R. S. (1981) Conceptual design of a surface measurement system for large deployable space antennas, 1981 *Large Space Systems Technology Proceedings, Part* 2, NASA cp-2215, pp. 631–640.

Collyor, P. W. et al (1981) Electro-optical system for remote position measurements in real time, 1981 *Large Space Systems Technology Proceedings, Part* 2, NASA cp 2215, pp 641–656.

The amplitude and phase of the signals at each feed element F are under control of computer-controller 10 which receives the range information developed by range finder 8. Computer/controller 10 may already be a part of the associated microwave signal processing equipment or may be a separate unit whose function is dedicated solely to the processing of range signals required by the present invention.

Unlike the feed array 4, the lens array 6 has no amplitude control units associated therewith. Each lens element 18 consists of a pair of back-to-back antennas 20 and 22 having a phase shifter C interposed therebetween. Each phase shifter C has a control lead which receives lens phase shifter signals ($C_1$–$C_{NL}$) from computer/controller 8 to vary the phase shifter setting, as is discussed in detail below.

Feed displacement occurs when the phased array feed 4 is not at its design location. The displacement may be due to a deployment malfunction, uneven heating from the sun, or other environmental effects. When the feed moves out of place, the phase and amplitude distribution radiated to the back of the lens array 6 changes. The lens phase shifters C no longer correct for this new non-planar wavefront and the effective illumination changes. Consequently, the antenna's far-field pattern is degraded (lower gain and higher sidelobes). The resulting far-field pattern may produce unacceptable performance, especially if the displacement is large and the required far-field sidelobes are low. Unless a method is contrived to correct for feed displacement, the antenna system may be useless.

One way to correct the feed displacement is to physically reposition feed array 4. This solution is unrealistic, though, when the antenna is in an unattended location and continuous adjustments are necessary. Even if possible this method would correct deployment errors but could not compensate for thermal expansion of the antenna. However, adjusting the phase and amplitude at the feed elements and/or the phase of the lens elements in order to approximate the desired field distribution can compensate for the displaced feed. This solution compensates for both deployment and thermal displacements. If the antenna's mechanical structure is not rigid enough to maintain the required performance specifications, then the adaptive feed compensation disclosed herein becomes necessary.

In the analysis that follows, it is assumed that the feed has NF equally spaced isotropic elements F. Likewise, the lens has NL equally spaced isotropic elements 18. In the quiescent state, the feed and lens are parallel to each other and have a separation distance of R wavelengths. Assuming that feed element m (where m=1, 2 . . . NF) has an amplitude $A_m$ and a phase $\phi_m$, the electric field intensity on the back of the lens is given by the equation:

$$E_n = \sum_{m=1}^{NF} (A_m/R_{nm}) \exp(j\phi_m - 2\pi j R_{nm}) \tag{1}$$

where $R_{nm}$=distance in $\lambda$ (wavelength) from element m of the feed to element n of the lens.

The antennas 20 on the feed side of the lens array 6 receive energy from the feed array 4, pass the signals through the phase shifters C, and reradiate them from the antennas 22 on the front side of the lens. It is assumed that all lens elements 18 are perfectly matched The phase shifter C in each lens element has a correction factor, $C_n$, applied thereto from computer/controller 10 (where n=1, 2 . . . NL) to compensate for the non-planar phase front radiated by the feed. $C_n$ is the phase shift necessary to adjust the signal phase in order to form a broadside beam. In addition, a linear phase shift may be superimposed on the correction factor to steer the main beam. For the purposes of this analysis however, it is assumed that the main beam is intended to be at boresite ($\theta$=0°) From the above information, the far field pattern of the antenna is given by the equation:

$$F = \sum_{n=1}^{NL} E_n \exp(jd_n u - jC_n) \tag{2}$$

Substituting equation (1) therein $$F = \sum_{n=1}^{NL} \sum_{m=1}^{NF} (A_n/R_{nm}) \exp(d_n u + \phi_m - C_n - 2\pi R_{nm}) \tag{3}$$

where $u = \sin\theta$ $\theta$=angle from boresite $d_n = d_o(n - 0.5 - NF/2)$ $d_o$=element spacing of lens.

Equations (2) and (3) hold true for a distorted or a nondistorted feed, since $R_{nm}$ takes into account any feed element displacement. If ($Xf_m$, $Yf_m$) and ($Xl_n$, $Yl_n$) represent the coordinates of the feed and lens elements respectively, then the distance from feed element m to lens element n is $$R_{nm} = \sqrt{(Xl_n - Xf_m)^2 + (Yl_n - Yf_m)^2} \quad (4)$$

The following is a summary of the individual error sources that were exercised in the model. While at any one time more than one could be present, the intent was to examine the individual error effects in order to identify trends, special effects, and the overall sensitivity of each effect. Generally the error sources can be divided into two broad classes that either produce symmetric or assymmetric effects which are seen in the predicted lens performance results.

Four different distortions were considered in the model: linear tilt, linear fold, parallel displacement, and perpendicular displacement which are graphically displayed in FIGS. 2*b*–2*e* respectively. When the feed has a linear tilt of $\Psi$, the element locations are given by ($Xf_m \cos \Psi$, $Xf_m \sin \Psi + R$). The variable $Xf_m$ is the x-coordinate of element m (in $\lambda$). A linear fold occurs when the feed bends in the middle and the two ends of the array move toward the lens or away from the lens. The element coordinates for the fold-in are ($Xf_m \cos \Psi$, $-|Xf_m| \sin \Psi + R$) and for the fold out ($Xf_m \cos \Psi$, $|Xf_m| \sin \Psi + R$). Finally, the feed can be distorted by a constant displacement along the y-axis with element location ($Xf_m$,$R+y_c$) or along the x-axis with new element locations given by($Xf_m+x_c$,R). Any combination of the above distortions is possible.

For the simulation, six elements were used in the feed spaced 0.44$\lambda$ apart and 30 elements in the lens spaced 0.5$\lambda$ apart. The feed and lens were separated by a distance $R=18\lambda$ giving the antenna an f/d ratio of 1.2. The feed element weights were chosen to yield a low sidelobe amplitude taper on the back of the lens. FIG. 3*a* shows the resulting far-field pattern of the lens (neglecting spillover). The far-field pattern is the quiescent pattern and will serve as the reference (desired pattern) for comparison with future calculations.

FIGS. 3*b*–3*d* show the far-field radiation patterns that result from tilting the feed. It is immediately apparent that the principal effect of feed tilt is a filling in of the sidelobe nulls. Only when the feed tilt is substantial does the peak sidelobe level increase significantly. Inspection of the curves of a 4°, 8°, and 12° tilt (FIGS. 3*b*, 3*c* and 3*d* respectively) show an increase in peak sidelobe level of 1, 8, and 11 dB respectively and an accompanying decrease in gain of 0, 1, and 2 dB. As expected, the mainbeam direction does not change with feed tilt.

The curves in FIGS. 4*a*–4*d* show the effects of folding. The difference between these and the previous set is evident. The peak of the sidelobes beyond the first is about the same as for the linear tilt and null depth is affected little. Some beam broadening is produced because of the absorption of the first sidelobe into the mainbeam.

When the feed is displaced parallel to the lens, two distinct pattern changes occur. As shown in FIGS. 5*a*–5*d*, the direction of the main beam is shifted and there is a dramatic deterioration in the quality of the sidelobe structure. It is also evident that, as expected, the symmetry of the pattern is destroyed. A longitudinal displacement of the feed position defocuses the system, thus introducing a quadratic phase error. As shown in FIGS. 6*a*–6*d*, the principal effect of this is the filling in of the close-in nulls and broadening of the mainbeam. Both lateral and longitudinal displacements produce an increase in average sidelobe level.

FIG. 7*a* shows the pattern that results with the feed having a 10° tilt, a 2$\lambda$ lateral displacement, and a 2$\lambda$ longitudinal displacement. This distorted pattern may be improved by adjusting the phase shifters in the feed and/or lens. The result when only the lens phase shifters are used to correct the errors is shown in FIG. 7*b*. Since the feed is no longer in its design configuration, the signals received by the elements on the back of the lens differ from the quiescent condition. Thus they are no longer properly corrected (cancelled) by the lens phased shifter settings, $C_n$. However by setting the lens phase shifters to a new $C_n$, the phases of the distorted signals can be readjusted to their correct values. Nothing can be done about the distorted amplitude taper because this lens has no amplitude control This type of compensation (FIG. 7*b*) can return the antenna beam to boresite and is particularly useful when the distorted amplitude distribution radiated to the feed side of the lens is symmetrical. If the amplitude distortion is skewed, the far field sidelobes increase relative to the mainbeam, but the lens correction cannot correct for this.

Proper adjustment of the phase and/or amplitude at each feed element can compensate for the feed displacement. The values for the feed weights are calculated in the following way. First, the ideal amplitude and phase of each of the thirty elements in the lens is transformed back to the six displaced feed element positions, and new feed excitation coefficients, $Z_m$ are obtained in accordance with the equation:

$$Z_m = \sum_{n=1}^{N} b_n \exp(jC_n - 2\pi j R_{nm}) \quad (5)$$

where $b_n$=amplitude of the signals at the lens elements. Then the complex conjugate of the coefficient $Z_m$ is formed and transformed back to the lens elements.

$$B_n = \sum_{m=1}^{M} Z_m^* \exp(-2\pi j R_{nm}) \quad (6)$$

At this point however, the calculated field intensity on the back of the lens does not equal the ideal because of the limitations of the two discrete Fourier transforms. In order to increase the accuracy of the estimation, the process is repeated with the new distribution as the starting point. This procedure is repeated until an acceptable error in the performance of the lens is obtained. Phase-only compensation retains the phase $\{Z_m\}$ from equation 5, but keeps the original feed amplitude weight $A_m$. FIG. 7*c* displays the result of the phase-only feed compensation on the distorted far-field pattern (no lens correction). It is evident that the phase-only feed compensation lowered the sidelobe levels of the antenna to almost the same level as the quiescent far field pattern. However, this compensation does not steer the mainbeam back to boresite when the feed is displaced parallel to the lens.

The next step in feed compensation was to adjust the amplitude as well as the phase of the feed elements This means both the amplitudes $Z_m$ and phases $\phi_m$ in equation 6 are used in the iterative process to find the new feed weights. Amplitude and phase compensation at the feed offered no advantages over the phase-only compensation. In fact, the amplitude and phase iterative process takes much longer to converge than the phase-only process. Moreover, the final phase and amplitude feed weights are the same as that obtained from the phase-only feed compensation. As far as correcting for feed displacement, phase-only correction at the feed is more appealing than amplitude and phase correction.

The result of incorporating simultaneous phase-only feed and lens compensation is shown in FIG. 7*d*. Inspection of the figure indicates that feed correction restores the sidelobe structure while lens correction realigns the main beam.

Although the invention has been described with reference to a particular embodiment, it will be understood to those skilled in the art that the invention is capable of a variety of alternative embodiments within the spirit and scope of the appended claims.

What is claimed is:

1. Apparatus for electronically correcting the far field pattern of a mechanically misaligned space fed lens antenna comprising:

a space fed lens antenna having a phased array feed and a phased array lens;

said phased array feed having a plurality of serially-connected phase shifters and feed elements;

said phased array lens having a plurality of serially-connected phase shifters and lens elements;

range finder means for determining the actual physical displacement of said phased array feed elements from said phased array lens elements and for providing range signals indicative thereof;

controller means for receiving said range signals and for providing first and second phase correction signals functionally related to said actual displacement and desired displacement of said feed elements from said lens elements;

means for applying said first phase correction signals to said phase shifters of said feed elements; and means for applying said second phase correction signals to the phase shifters of said lens elements;

whereby the far field pattern of said space fed lens antenna is optimized.

2. Apparatus as defined in claim 1 wherein said first phase correction signals vary in accordance with the equation:

$$\text{Phase}\{A_m\} = \text{Phase}\left\{\sum_{n=1}^{NL} b_n \exp(jC_n - 2\pi jR_{nm})\right\}$$

where:

$b_n$=amplitude of the signals at the lens elements $$R_{nm} = \sqrt{(Xl_n - Xf_m)^2 + (Yl_n - Yf_m)^2}$$

where:

$(Xf_m, Yf_m)$ are the feed element location coordinates $(Xl_n, Yl_n)$ are the lens element location coordinates.

3. Apparatus as defined in claim 2 wherein said second phase correction signals vary in accordance with the equation:

$$\text{Phase}\{B_m\} = \text{Phase}\left\{\sum_{m=1}^{NF} A_m^* \exp(-2\pi jR_{nm})\right\}$$

where:

$A_m^*$=complex conjugate of the signal at feed element m $$R_{nm} = \sqrt{(Xl_n - Xf_m)^2 + (Yl_n - Yf_m)^2}$$

where:

$(Xf_m, Yf_m)$ are the feed element location coordinates $(Xl_n, Yl_n)$ are the lens element location coordinates.

4. Apparatus as defined in claim 3 wherein said controller means further provides amplitude correction signals functionally related to said actual and desired displacement of said feed elements from said lens elements.

5. Apparatus as defined in claim 4 and further comprising:

feed signal amplitude adjusters coupled to said phase shifters of each of said feed elements; and means for coupling said amplitude correction signals to said feed signal amplitude adjusters.

6. Apparatus as defined in claim 5 wherein said amplitude correction signals vary in accordance with the equation:

$$A_m = \sum_{n=1}^{NL} b_n \exp(jC_n - 2\pi jR_{nm})$$

where:

$$R_{nm} = \sqrt{(Xl_n - Xf_m)^2 + (Yl_n - Yf_m)^2}$$

7. A method for electronically compensating for undesired variations in the far field pattern of a space fed lens antenna resulting from the misalignment of its phased array feed elements with its phased array lens elements comprising:

(a) measuring the actual physical displacement of said feed element from said lens elements and forming range signals indicative thereof;

(b) calculating from said range signals and from predetermined range data related to the proper physical displacement of said feed elements from said lens elements, first and second error correction signals;

(c) applying said first error correction signals to said feed elements to shift the phase of signals therein and thereby lower the sidelobe amplitude taper of said antenna; and (d) applying said second error correction signals to said lens elements to shift the phase of signals therein and collimate the beam leaving said antenna.

* * * * *